US006312212B1

(12) United States Patent
Burlew, Jr.

(10) Patent No.: US 6,312,212 B1
(45) Date of Patent: Nov. 6, 2001

(54) COUPLER ASSEMBLY

(75) Inventor: Charles K. Burlew, Jr., Cary, NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/240,990

(22) Filed: Jan. 29, 1999

(51) Int. Cl.[7] ..... E02F 3/36
(52) U.S. Cl. ..... 414/723; 37/468
(58) Field of Search ..... 414/723, 686; 403/3, 4, 13; 37/468; 172/272–275

(56) References Cited

U.S. PATENT DOCUMENTS

| | | | | |
|---|---|---|---|---|
| 3,572,759 | * | 3/1971 | Baugh et al. | 172/272 |
| 3,874,533 | | 4/1975 | Montgomery et al. | 214/145 |
| 3,934,738 | | 1/1976 | Arnold | 214/145 A |
| 4,452,560 | | 6/1984 | Coyle et al. | 414/723 |
| 4,643,631 | | 2/1987 | Maurer et al. | 414/723 |
| 4,761,113 | | 8/1988 | Smith et al. | 414/732 |
| 4,854,812 | | 8/1989 | Smith et al. | 414/723 |
| 4,854,814 | | 8/1989 | Smith et al. | 414/723 |
| 5,252,022 | * | 10/1993 | Culp et al. | 414/723 |
| 5,382,110 | * | 1/1995 | Perotto et al. | 414/723 X |
| 5,634,735 | | 6/1997 | Horton et al. | 403/322 |
| 5,727,342 | | 3/1998 | Horton | 37/468 |
| 5,732,488 | * | 3/1998 | Smith | 414/723 X |
| 5,779,429 | * | 7/1998 | Poole | 414/723 |

FOREIGN PATENT DOCUMENTS

| | | | |
|---|---|---|---|
| 90/08234 | 7/1990 | (WO) | E02F/3/96 |
| 91/18716 | 12/1991 | (WO) | B25G/3/18 |

OTHER PUBLICATIONS

John Deere Parts Catalog—PC2574 (Apr. 1998)—310E, 310SE and 315SE Backhoe Loaders.

* cited by examiner

*Primary Examiner*—Donald W. Underwood
(74) *Attorney, Agent, or Firm*—Diana L. Charlton

(57) ABSTRACT

The present invention includes a coupler assembly for attaching a work implement to a work machine. The coupler assembly includes an attachment hook which has an upper jaw with an adjustment surface and a lower jaw with a locating surface. The adjustment surface of the upper jaw includes a plurality of interconnected arcuate notches therealong so that a pin receiving opening is defined between the adjustment surface and the locating surface. The plurality of arcuate notches in the adjustment surface in cooperation with the locating surface allow for a plurality of various pins to be aligned and seated automatically within a seating position correspondent to the diameter of the pin. The automatic alignment and seating virtually eliminates operator involvement during the alignment process, thereby reducing time and costs.

6 Claims, 5 Drawing Sheets

COUPLER ASSEMBLY

TECHNICAL FIELD

This invention relates generally to a coupler assembly for construction machines and more particularly to configuring a hook portion of the coupler assembly to include an upper surface formed with a plurality of radii for attaching a variety of work implements to the construction machine.

BACKGROUND ART

Present construction machines, such as backhoe loaders, may incorporate manual or hydraulic couplers to release and attach various work implements or tools during normal daily operation. Typically, the couplers include hook portions for receiving the various work implements via a pin which generally has a standard diameter. However, it is sometimes necessary to attach specific work implements which utilize different pin diameters during the attachment process. In order to accommodate these specific work implements, it is evident that the couplers must be flexible for receiving various pin diameters.

Some designs have reconfigured the hook portions of the coupler to accommodate this flexibility. The hook portions include a pin receiving opening with a lower surface formed with a plurality of radii. The radii define a plurality of positions therealong which accommodate the seating of variable pin diameters. Due to the location of the radii on the lower surface, the various pins utilized are substantially seated in each position until the position of corresponding diameter is reached. Therefore, the pins are not automatically seated within the corresponding diameter position and may require additional force by an operator, increasing time and costs.

The present invention is directed to overcoming the problems as set forth above.

DISCLOSURE OF THE INVENTION

In one aspect of the present invention, a coupler assembly is provided for attaching a work implement to a work machine. The coupler assembly comprises a plate assembly with front and rear end portions. An attachment plate is connected at the rear end portion of the plate assembly and extends therefrom. An attachment hook is connected at the front end portion of the plate assembly and extends therefrom in a spaced relationship with the attachment plate. The attachment hook has an upper jaw with a adjustment surface and a lower jaw with a locating surface. The lower jaw is spaced from the upper jaw for defining a pin receiving opening between the locating surface and the adjustment surface. The adjustment surface of the upper jaw defines a plurality of interconnected arcuate notches therealong.

In another aspect of the present invention, a coupler assembly is provided for attaching a work implement to a work machine. The coupler assembly comprises a pair of spaced support plates. A strengthening plate assembly extends between the spaced support plates for connection therewith. The strengthening plate assembly has front and rear end portions. An attachment plate is connected at the rear end portion of the strengthening plate assembly and extends therefrom opposite the spaced support plates. An attachment hook is connected at the front end portion of the strengthening plate assembly and extends therefrom opposite the spaced support plates in a spaced relationship with the attachment plate. The attachment hook has an upper jaw with a adjustment surface and a lower jaw with a locating surface. The lower jaw being spaced from the upper jaw for defining a pin receiving opening between the locating surface and the adjustment surface. The adjustment surface of the upper jaw defining a plurality of interconnected arcuate notches therealong.

The present invention includes a coupler assembly with an attachment hook which has upper jaw with an adjustment surface spaced from a lower jaw with a locating surface. The adjustment surface of the upper jaw includes a plurality of interconnected arcuate notches therealong so that a pin receiving opening is defined between the adjustment surface and the locating surface. The plurality of arcuate notches in the adjustment surface allow for a plurality of various pins to be seated within the pin receiving opening for attaching a work implement to a work machine. The location of the arcuate notches in the adjustment surface, in cooperation with the locating surface, allow for automatic alignment of the various pins in a corresponding sized arcuate notch. The automatic alignment virtually eliminates operator involvement during the alignment process, thereby reducing time and costs.

BEST MODE FOR CARRYING OUT THE INVENTION

Figure 1:
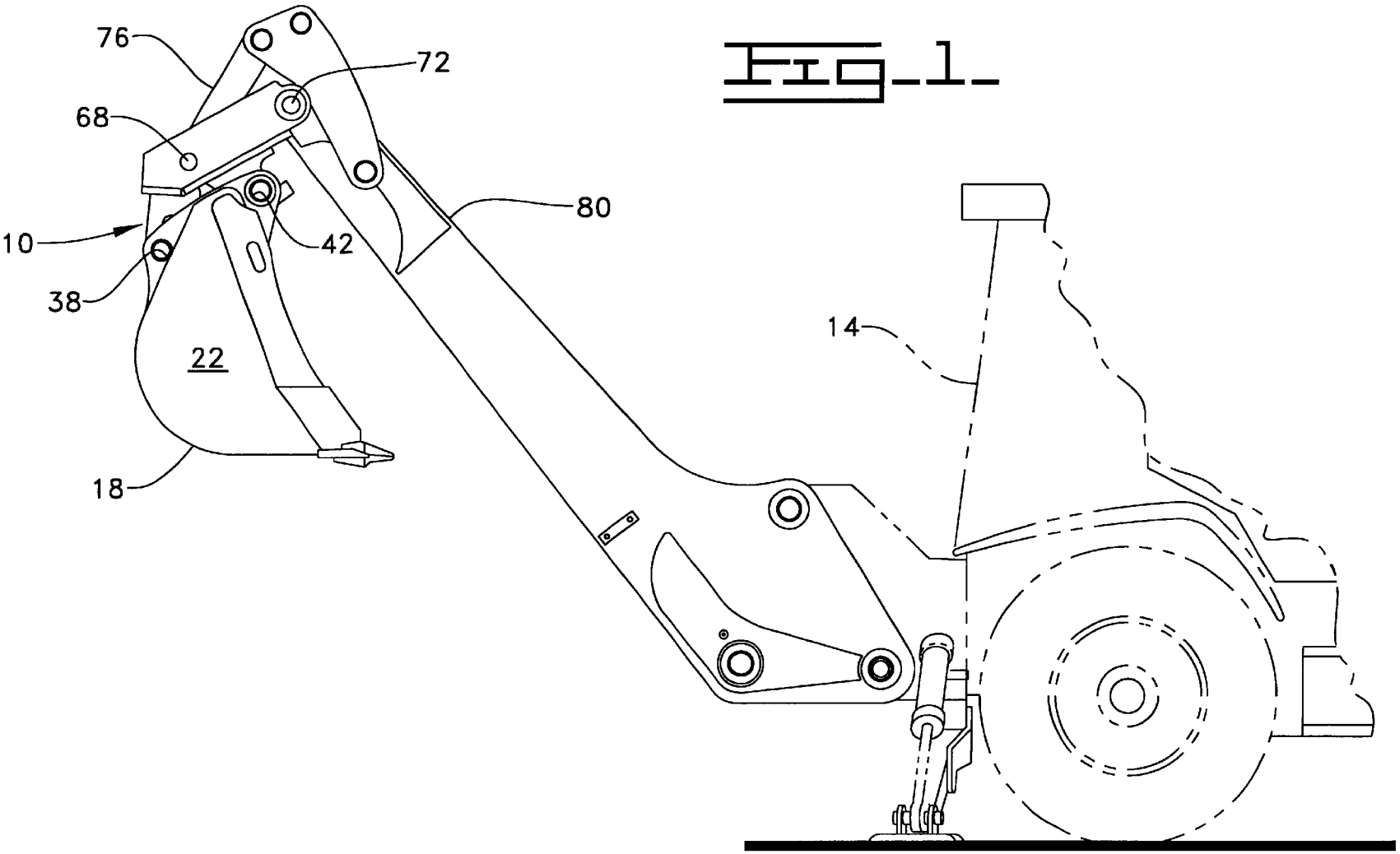
FIG. 1 is a partial side view of a work machine including the present invention coupler. assembly carrying a work implement.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
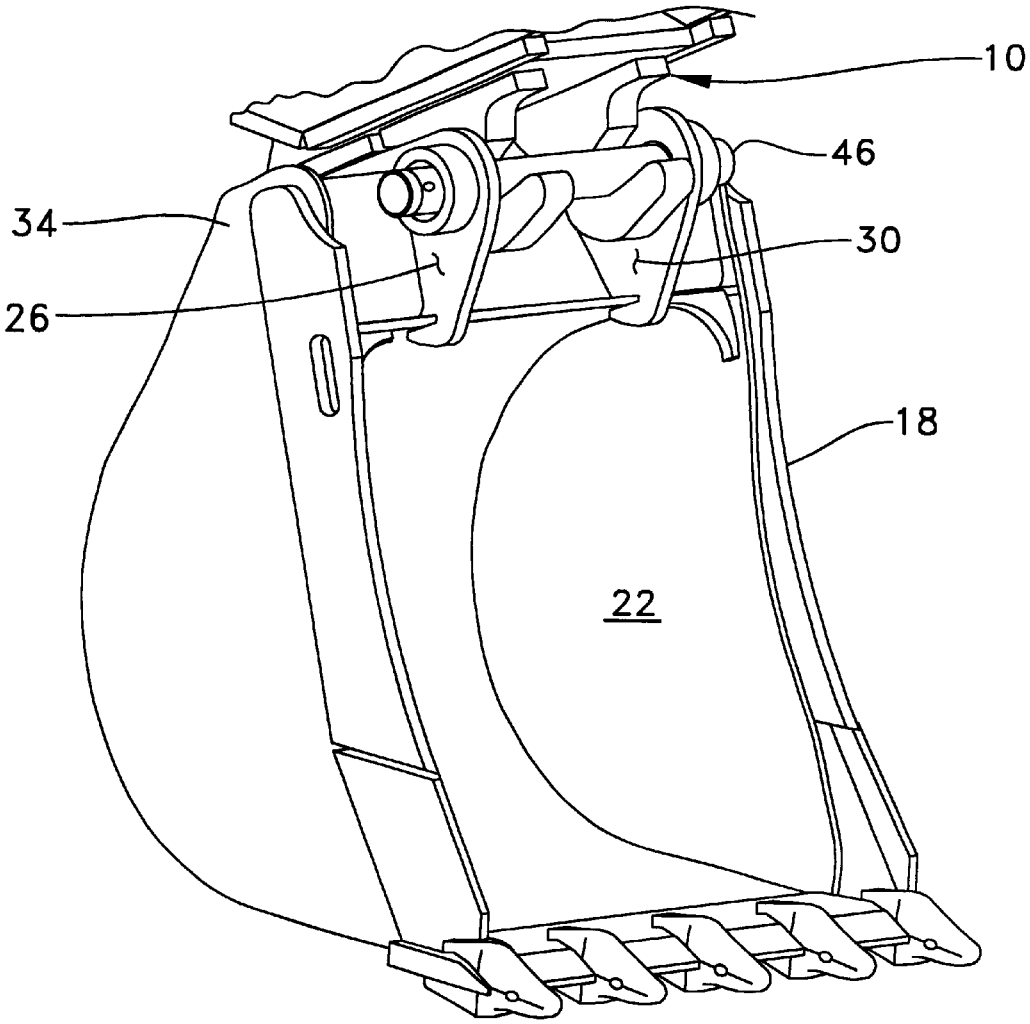
FIG. 2 is a perspective view of the coupler assembly carrying the work implement and detached from the work machine.
Figure 3:
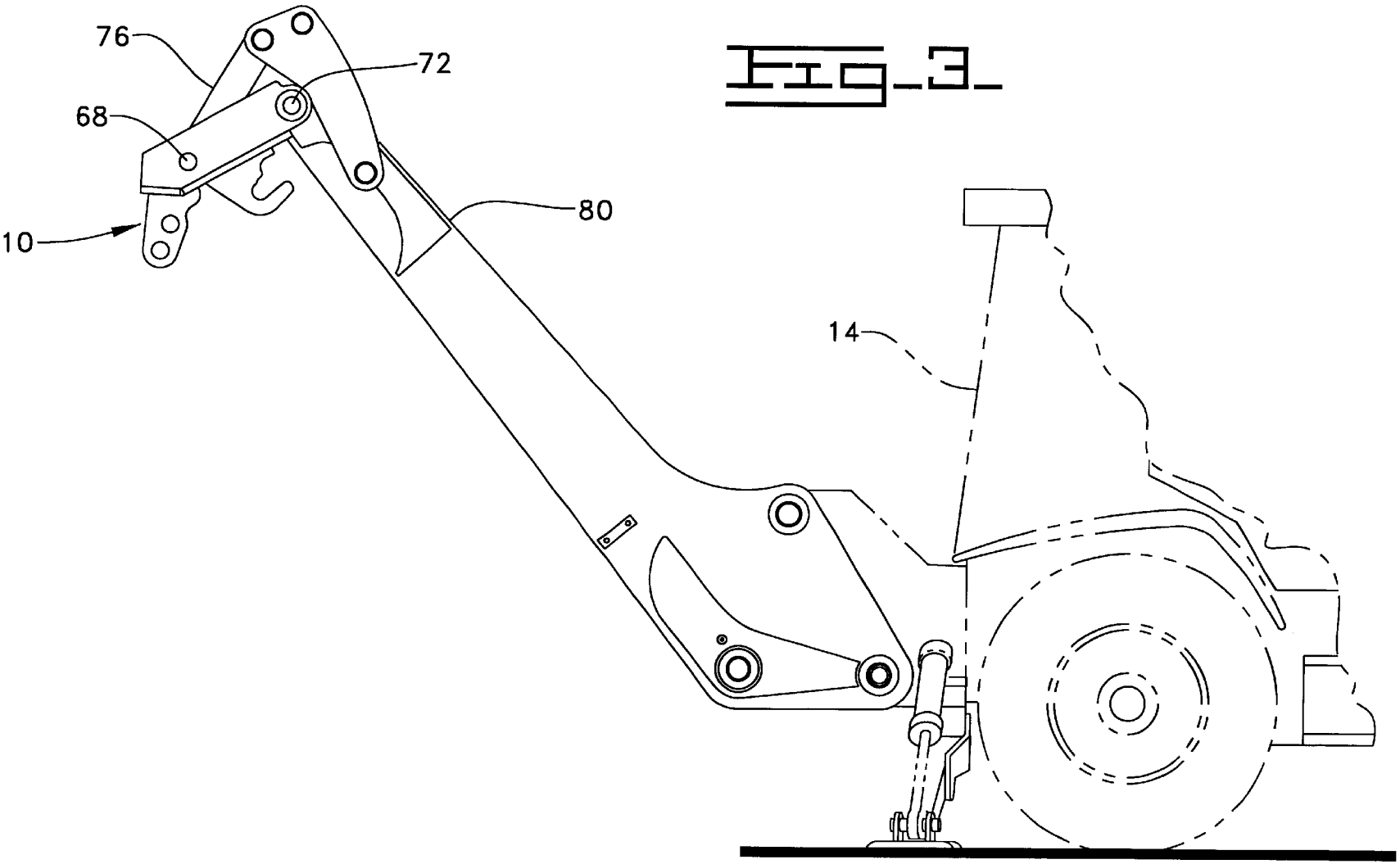
FIG. 3 is partial side view of the work machine including the coupler assembly without the work implement attached.
Figure 4:
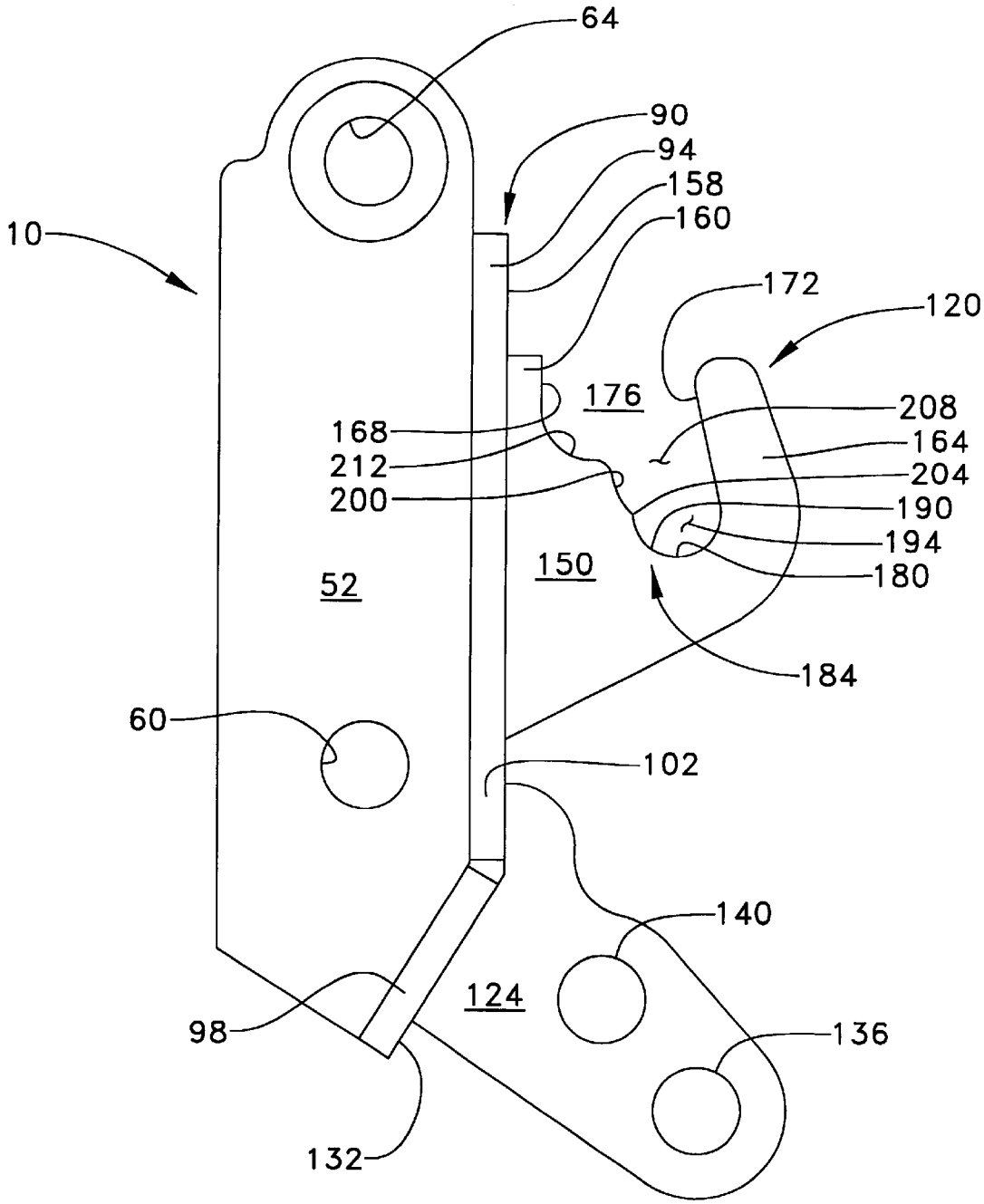
FIG. 4 is a side view of the coupler assembly.
Figure 5:
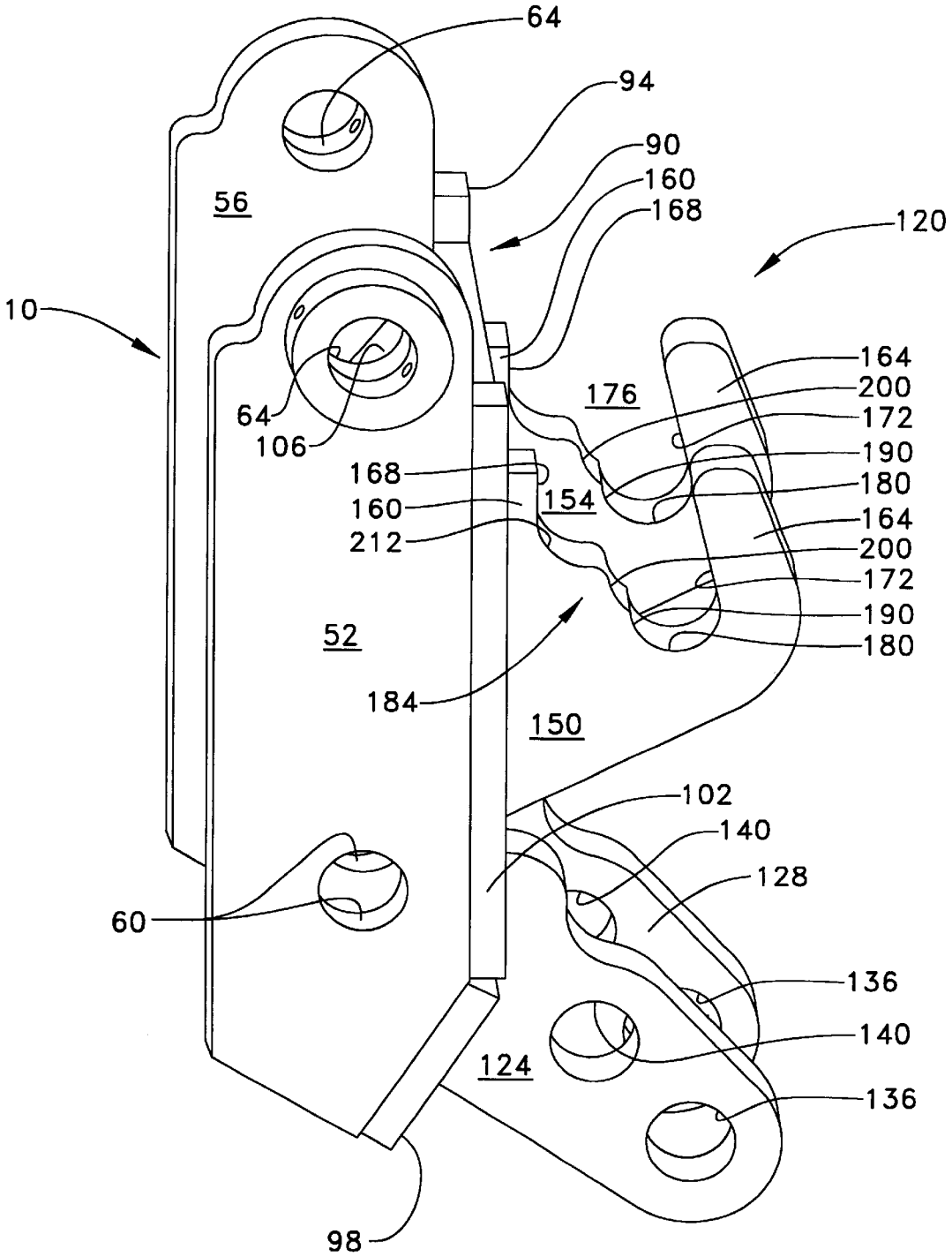
FIG. 5 is a perspective view of the coupler assembly.

Referring to the drawings, it can be seen that a coupler assembly 10 for use on a construction machine 14, such as a backhoe loader, is disclosed which couples a work implement or tool 18 to the construction machine 14. The work implement 18, shown in FIGS. 1–2, is a conventional bucket assembly of any suitable design. The bucket assembly 18 includes a bucket 22 and a pair of connection plates 26,30 positioned at an uppermost portion 34 of the bucket 22. The connecting plates 26,30 each have a pair of openings therethrough, one of which is shown at 38,42 on connecting plate 26. The respective openings 38,42 on connecting plates 26,30 are coaxially aligned. A pin 46 with a predetermined diameter is removably connected on the bucket assembly 22 and extends through openings 42. It should be understood that the work implement 18 may be any suitable type of work tool having various pin diameters 46 and are anticipated by the present invention. The coupler assembly 10, shown more clearly in FIGS. 4–5, has a pair of spaced support plates 52,56 with a pair of respective openings 60,64 therethrough. The pair of openings 60,64 on the support plates 52,56 are coaxially aligned. Pins 68,72, seen in FIGS. 1 and 3, extend through the coaxially aligned openings 60,64 to connect the coupler assembly 10, respectively, to a linkage assembly 76 and lift arm assembly 80. It should be understood that the coupler assembly 10 may be connected to the machine 14 in any suitable manner to establish suitable operation of the coupler assembly 10 therewith.

Referring again to FIGS. 4–5, the coupler assembly 10 has a strengthening plate assembly 90 with a box-like structure which is formed by a plurality of individual plates. The individual plates include a planar bottom plate 94 which connects the support plates 52,56 and extends therebetween, a back plate 98 which connects to a rear portion 102 of the bottom plate 94 and extends angularly therefrom for connection between the support plates 52,56, and a bent strengthening plate 106 which connects to the bottom plate 94 and back plate 98 for extension between the support plates 52,56 and connection therewith. An attachment assembly 120 is connected to the strengthening plate assembly 90 for coupling the work implement 18 with the machine 14.

The attachment assembly 120 includes a pair of spaced attachment plates 124,128 which are connected to a lower surface 132 of the back plate 98 and extend perpendicularly therefrom in an opposite direction from the support plates 52,56. The attachment plates 124,128 each have a pair of respective openings 136,140 therethrough. The pair of openings 136,140 on the attachment plates 124,128 are coaxially aligned. The attachment assembly 120 further includes a pair of attachment hooks 150,154 connected to a lower surface 158 of the bottom plate 94. The attachment hooks 150,154 extend in an angular relationship from the bottom plate 94 in an opposite direction from the support plates 52,56. Each of the attachment hooks 150,154 have a spaced relationship with a respective attachment plate 124,128 and are axially aligned therewith.

The attachment hooks 150,154 include upper and lower jaws 160,164. The upper jaw 160 includes an adjustment surface 168 extending downwardly from the bottom plate 94 in a spaced, angular relationship with a locating surface 172 of the lower jaw 164 so as to define a pin receiving opening 176 therebetween. The upper and lower jaws 160,164 meet at an arcuate intersection 180 with the locating surface 172 of the lower jaw 164 extending therefrom at an upward incline toward the bottom plate 94 to create a sloped contact area. A plurality of interconnected arcuate notches 184 are defined in the adjustment surface 168 of the upper jaw 160. A first arcuate notch 190 is an extension of the arcuate intersection and has a first radius. The first arcuate notch 190 is operatively associated with the arcuate intersection 180 and a portion of the locating surface 172 to define a first seating position 194. A second arcuate notch 200 has a larger radii than the first arcuate notch 190 and is interconnected with the first arcuate notch 190 so that a connecting stop 204 is defined therebetween. The second arcuate notch 200 and a portion of the locating surface 172 define a second seating position 208. A clearance notch 212 has a larger radii than the second arcuate notch 200 and is interconnected therewith. The first and second seating position 194,208 correspond with one of the respective pairs of openings 136,140 in the attachment plates 124,128 to define a spatial relationship therebetween. It should be understood that a plurality of radii may be defined in the adjustment surface 168 in a similar manner to accommodate additional pin diameters 46.

INDUSTRIAL APPLICABILITY

During the attachment process, the pin receiving opening 176 in the attachment hooks 150,154 receives the pin 46 of the grounded bucket assembly 18. The bucket assembly 18 is lifted off the ground so that the pin 46 is moved along the inclined locating surface 172 of the lower jaw 164 due to weight and gravity. The pin will continue to move along the inclined locating surface 172 until it automatically aligns and seats within one of the corresponding seating positions 194,208. The seating of the pin 46 occurs automatically because the adjustment surface 168 of the upper jaw 160 is constructed to allow smaller diameter pins 46 to move past the second seating position 208 for automatic seating in the first seating position 194. The connecting stop 204 restricts larger diameter pins 46 from entering the first seating position 194 so that the larger diameter pins 46 are automatically seated within the second seating position 208. After the pin 46 is automatically seated, the bucket assembly 18 is lowered to the ground until the coaxial openings 38 in the connection plates 26,30 are coaxially aligned with one of the coaxial openings 136,140 of the attachment plates 124, 128. A pin is then extended through the aligned openings for firmly connecting the bucket assembly 18 to the work machine 14 in a conventional manner. The alignment of the connection plate openings 38 with one of the attachment plate openings 136,140 is dependent on the seating position 194,208 being used and the specific construction of the various work implements 18. The ability to automatically seat various sized diameter pins allows for a flexible coupler assembly 10. The automatic alignment and seating of the various pins achieved by the adjustment surfaces 168 of the upper jaw 160, operating in conjunction with the inclined locating surface 172 of the lower jaw 164, saves time and costs during the attachment process.

Other aspects, objects and advantages of this invention can be obtained from a study of the drawings, disclosure and the appended claims.

What is claimed is:

1. A coupler assembly for attaching a variety of work implements with varying sized pins to a work machine, comprising:

a plate assembly having front and rear end portions;

an attachment plate connected at the rear end portion of the plate assembly and extending therefrom; and an attachment hook connected at the front end portion of the plate assembly and extending therefrom in a spaced relationship with the attachment plate, the attachment hook having an upper jaw with a adjustment surface and a lower jaw with a locating surface, the lower jaw being spaced from the upper jaw for defining a pin receiving opening between the locating surface and the adjustment surface, the adjustment surface of the upper jaw defining a plurality of interconnected arcuate notches therealong, each of the arcuate notches corresponding to one of the variety of work implements for seating the respective pin of the work implement therein.

2. The coupler assembly of claim 1, wherein the adjustment surface of the upper jaw and the locating surface of the lower jaw meet at an arcuate intersection therebetween and the lower jaw extends upwardly from the arcuate intersection toward the plate assembly to establish an angular relationship between the locating surface and the adjustment surface.

3. The coupler assembly of claim 2, wherein the arcuate intersection, one of the plurality of arcuate notches in the adjustment surface of the upper jaw, and a portion of the locating surface of the lower jaw define one of a plurality of seating positions between the upper and lower jaws.

4. The coupler assembly of claim 3, wherein the one of the plurality of arcuate notches has a smaller radius than the other plurality of arcuate notches, the other of the plurality of arcuate notches having progressively increasing radii as each extend outwardly from the one of the plurality of arcuate notches, the other of the plurality of arcuate notches of the upper jaw and a respective portion of the locating surface of the lower jaw define the other of the plurality of seating positions between the upper and lower jaws.

5. The coupler assembly of claim 4, wherein the attachment plate defines a plurality of openings therethrough corresponding with a respective seating position between the upper and lower jaws to define a predetermined spatial relationship therebetween.

6. A coupler assembly for attaching a variety of work implements with varying sized pins to a work machine, comprising:

a pair of spaced support plates;

a strengthening plate assembly extending between the spaced support plates for connection therewith, the strengthening plate assembly having front and rear end portions;

an attachment plate connected at the rear end portion of the strengthening plate assembly and extending therefrom opposite the spaced support plates; and an attachment hook connected at the front end portion of the strengthening plate assembly and extending therefrom opposite the spaced support plates in a spaced relationship with the attachment plate, the attachment hook having an upper jaw with a adjustment surface and a lower jaw with a locating surface, the lower jaw being spaced from the upper jaw for defining a pin receiving opening between the locating surface and the adjustment surface, the adjustment surface of the upper jaw defining a plurality of interconnected arcuate notches therealong, each of the arcuate notches corresponding to one of the variety of work implements for seating the respective pin of the work implement therein.

* * * * *